US012662723B2

(12) United States Patent
Sutton et al.

(10) Patent No.: US 12,662,723 B2
(45) Date of Patent: Jun. 23, 2026

(54) HIGH STRENGTH, COMBUSTION-RESISTANT, TUBE-EXTRUDABLE AIRCRAFT-GRADE MAGNESIUM ALLOY

(71) Applicant: Mag Specialties, Inc., Denver, CO (US)

(72) Inventors: Scott C. Sutton, Parker, CO (US); Daniel D. Hartman, Parker, CO (US); Nes Abdulrahman, Arvada, CO (US); Dean Robert Hartwick, Haley Station (CA)

(73) Assignee: Mag Specialties, Inc., Denver, CO (US)

( * ) Notice: Subject to any disclaimer, the term of this patent is extended or adjusted under 35 U.S.C. 154(b) by 0 days.

(21) Appl. No.: 18/587,871

(22) Filed: Feb. 26, 2024

(65) Prior Publication Data

US 2024/0247343 A1 Jul. 25, 2024

Related U.S. Application Data

(63) Continuation of application No. 16/555,919, filed on Aug. 29, 2019, now abandoned.

(51) Int. Cl.
*C22C 23/02* (2006.01)
*B21C 1/00* (2006.01)

(52) U.S. Cl.
CPC ..... *C22C 23/02* (2013.01); *B21C 1/003* (2013.01)

(58) Field of Classification Search
CPC ..... B21C 1/003; C22C 23/02; C22F 1/06
See application file for complete search history.

(56) References Cited

U.S. PATENT DOCUMENTS

| | | | | |
|---|---|---|---|---|
| 3,826,122 | A | 7/1974 | Braeuninger | |
| 5,078,962 | A | 1/1992 | Gilles et al. | |
| 9,822,432 | B2 | 11/2017 | Kim et al. | |
| 2009/0269237 | A1* | 10/2009 | Satoh | C22C 1/0408 420/409 |
| 2011/0039106 | A1 | 2/2011 | Gruber et al. | |
| 2013/0280121 | A1 | 10/2013 | Kim et al. | |

FOREIGN PATENT DOCUMENTS

| | | | |
|---|---|---|---|
| CN | 101037753 | A | 9/2007 |
| CN | 102310295 | A | 1/2012 |
| CN | 105256206 | A | 1/2016 |
| CN | 105385917 | A | 3/2016 |
| CN | 108555477 | A | 9/2018 |

(Continued)

OTHER PUBLICATIONS

NPL-1: Fujita et al., Synthesis of Al2Ca dispersoids by powder metallurgy using a Mg—Al alloy and CaO particles, Materials, vol. 200, Jun. 2017, 10, 716, pp. 1-13 (Year: 2017).*

(Continued)

*Primary Examiner* — Jie Yang
(74) *Attorney, Agent, or Firm* — Berg Hill Greenleaf Ruscitti LLP

(57) ABSTRACT

Embodiments of the invention include magnesium-based alloys especially adapted for extrudable aerospace grade applications. Alloys of the invention provide excellent combinations of mechanical properties, good extrudability in hollow forms, and resistance to combustion.

7 Claims, 3 Drawing Sheets

(56) References Cited

FOREIGN PATENT DOCUMENTS

| | | | |
|---|---|---|---|
| EP | 2634278 | A1 | 9/2013 |
| KR | 20160011136 | A | 1/2016 |
| KR | 20160075143 | A | 6/2016 |

OTHER PUBLICATIONS

Mingo et al. Article entitled "Corrosion of Mg—9Al alloy with minor alloying elements(Mn, Nd, Ca, Y and Sn)" Material and Design 130 (2017) p. 48-48. Published online May 15, 2017. Retrieved Oct. 28, 2019. ul<https://bura.brunel.ac.uk/bistream/2438/18876/3/FullText.pdf>Entire document, especially 54 col. 2, para 3.
International Search Report in international application No. PCT/US19/49045 mailed on Nov. 15, 2019.
Written Opinion in international application No. PCT/US19/49045 mailed on Nov. 15, 2019.
International Preliminary Report on Patentability in International Application No. PCT/US19/49045 mailed on Jun. 10, 2022, 8 pages.
Notification of The First Office Action in CN Application No. 2019800995010 mailed on issued on Feb. 10, 2023; 7 pages.
Yu, Y., & Wang, E. (2009). The Effects of Cold Extrusion on Grain Size and Plasticity for Magneisum Alloy. International Journal of Modern Physics B, 23, 821-825.
Chen, Y., Wang, Q., Peng, J., Zhai, C., & Ding, W. (2007). Effects of extrusion ratio on the microstructure and mechanical properties of AZ31 Mg alloy. Journal of Materials Processing Technology, 182(1-3), 281-285.
Park, S. S., You, B. S., & Yoon, D. J. (2009). Effect of the extrusion conditions on the texture and mechanical properties of indirect-extruded Mg—3Al—1Zn alloy. Journal of Materials Processing Technology, 209(18-19), 5940-5943.
Atwell, D. L., & Barnett, M. R. (2007). Extrusion limits of magnesium alloys. Metallurgical and Materials Transactions A: Physical Metallurgy and Materials Science, 38 A(12), 3032-3041.
Zubair, M., Sandlobes-Haut, S., Pei, R., Wollenweber, M. A., Berners, L., Kusche, C. F., Liu, C., Roters, F., Gibson, J. S. K. L., & Korte-Kerzel, S. (2023). Strengthening of Mg—Al—Ca alloys with C15 and C36 Laves phases. Journal of Materials Research.
Notification of The Second Office Action in CN Application No. 2019800995010 mailed on issued on Sep. 7, 2023; 9 pages.
Extended European Sear Report in EP Application No. 19943070.3 received on Aug. 1, 2022, 43 pages.
Zhu et al., Highly deformable Mg—Al—Ca alloy with Al2Ca precipitates, Acta Materialia, vol. 200, Nov. 2020, (Year: 2020).

* cited by examiner

HIGH STRENGTH, COMBUSTION-RESISTANT, TUBE-EXTRUDABLE AIRCRAFT-GRADE MAGNESIUM ALLOY

CROSS REFERENCE TO RELATED APPLICATIONS

This application is a continuation of U.S. application Ser. No. 16/555,919, filed Aug. 29, 2019; The entire specification and figures of the above-referenced application is hereby incorporated in their entireties by reference.

FIELD OF THE INVENTION

The present invention relates to high strength wrought magnesium alloys designed for aerospace applications. More specifically, the invention includes a Mg—Al—Zn—Mn—Ca—Y alloy, which is non-flammable and improves on extrudability and mechanical properties of conventional alloys. The invention also includes a method of making the alloy in a selected manufacturing process.

BACKGROUND OF THE INVENTION

In automotive and aerospace applications, lightweight materials are increasingly used to replace heavy structural elements in order to increase vehicle fuel efficiency. Titanium and aluminum are common material choices for reducing weight in structural applications, but magnesium alloys are superior because they have the lowest density of any structural metal and can achieve higher specific strengths (strength to weight ratio) than other metals. However, there are significant design challenges which have prevented the implementation of a commercial alloy in aerospace applications.

There are several distinct challenges for magnesium alloys in aerospace applications. The main challenges include strength, workability, cost, and flammability. Strength requirements are straightforward; because magnesium competes mainly with higher strength aluminum and titanium alloys, it must have high strength in order to substitute into any existing application. Workability and cost requirements are interrelated and are dependent on alloy strengths. Most aerospace components have complex shapes with high strength or stiffness to weight ratios. These shape and strength/stiffness requirements, as well as differing wall thicknesses, all necessitate a highly workable alloy. Alloys with moderate or low workability must be extruded at higher temperatures and lower speeds in order to make these complex shapes; this translates into high process costs. While not a consideration for other structural metals, magnesium alloys in commercial aerospace applications must also be nonflammable or self-extinguishing if ignited. Flammability resistance is required due to stringent safety regulations that mandate aggressive testing of magnesium alloys. All of these criteria must be met in order for a magnesium extrusion alloy to be commercially viable for the aerospace industry.

Individually, solutions exist for each of these challenges, but the solutions are often incompatible or contradictory. For example, high alloying content of aluminum or zinc results in high strength, but reduces workability, as visible in commercial alloy AZ80, which is not extrudable in tube, and alloy ZK60, which is extrudable only very slowly in any form factor. Calcium additions contribute to the flammability resistance of magnesium alloys, but they can also lower the strength, ductility, and/or toughness of the alloy. Significant additions of yttrium and rare earth elements, as in alloy WE43, result in high strengths and flammability resistance; however, such additions are detrimental to workability and are cost-prohibitive. Lean alloys that have little alloying content are easily workable and inexpensive, but they fail all other design criteria. There remains a need for an alloy which satisfies all essential design criteria: good mechanical properties, combustion resistance, and workability and low cost.

SUMMARY OF THE INVENTION

The present invention relates to magnesium alloys that are ideally suited for applications in aerospace and automotive applications. The alloys have good flammability resistance, and extrudability, as well as superior as-fabricated mechanical properties to similar conventional alloys.

The present invention provides for embodiments that incorporate different ranges of alloying content which gives flexibility and a good balance of options for processing and mechanical properties.

According to one aspect of the invention, the alloys may lie in composition ranges (by weight) of between about 7.0 to 11.0% aluminum, 0.1 to 0.8% zinc, 0.15 to 0.65% manganese, 0.6 to 1.5% calcium, and 0.05 to 0.6% yttrium with remainder of magnesium and incidental or unavoidable impurities.

According to one preferred embodiment of the invention, it may be considered a magnesium-based extrusion alloy composition comprising, by weight: 7.0%-11.0% Al, 0.1%-0.8% Zn, 0.15%-0.65% Mn, 0.6%-1.5% Ca, 0.05%-0.6% Y and a balance of Mg and unavoidable impurities.

There are a number of additional optional features of the first preferred embodiment. One optional feature is wherein a content of said Mn is between about 0.15 wt % to 0.3 wt % of said alloy.

Another optional feature is wherein a content of said Zn is between about 0.1 wt % to 0.35 wt % of said alloy.

Another optional feature is wherein a content of said Zn is between about 0.4 wt % to 0.6 wt % of said alloy.

Another optional feature is wherein a content of said Al is between about 8.3 wt % to 10 wt % of said alloy.

Another optional feature is wherein a content of said Ca and Y is between about 0.75 wt % to 1.5 wt % of said alloy.

Another optional feature is wherein a total combined content of said Al, Ca, and Y does not exceed 11 wt % of said alloy.

Another optional feature is wherein said Ca and said Y are provided in intermetallic compounds.

Another optional feature is wherein said intermetallic compounds of Ca and Y comprise Mg—Al—Ca compounds and Al—Mn—Y compounds, respectively.

Another optional feature is wherein said Mg—Al—Ca intermetallic compound comprises up of up to 57 wt % Al and up to 43 wt % Ca.

Another optional feature is wherein said Al—Mn—Y intermetallic compound comprises 40 wt % Al, 40 wt % Mn and 20 wt % Y.

Another optional feature is wherein said Ca and Y intermetallic compounds contribute to flammability resistance of wrought products made from said alloy.

Another optional feature is wherein said alloy comprises Ca in the form of intermetallic particles; said particles having an average diameter of about less than 1 μm and finely distributed within said alloy.

Another optional feature is wherein said intermetallic particles are formed in a wrought process, including extrusion, rolling, or forging.

Another optional feature is wherein when said alloy is provided in a matrix phase, particles making up said alloy have an average diameter of about 10 μm or less.

Another optional feature is wherein said alloy comprises Ca intermetallic particles and said particles make up between about 1.0% to 5.0% of said alloy by volume.

Another optional feature is wherein said alloy has a tensile yield strength of at least 180 MPa and an ultimate tensile strength of at least 270 MPa.

Yet another optional feature is wherein said forged or drawn alloy has a tensile yield strength of at least 170 MPa, an ultimate tensile strength of at least 280 MPa and an elongation of at least 7% in tube forms.

According to another preferred embodiment of the invention, it may be considered a method of making a product made from a magnesium-based alloy composition comprising the steps of: providing magnesium-based alloy composition comprising, by weight: 7.0%-11.0% Al, 0.1%-0.8% Zn, 0.15%-0.65% Mn, 0.6%-1.5% Ca, 0.05%-0.6% Y and a balance of Mg and unavoidable impurities; subjecting said alloy to extrusion to produce an extruded alloy; or subjecting said alloy to rolling to produce a rolled alloy; or subjecting said alloy to forging to produce a forged alloy.

One optional feature of the method is wherein said extrusion step comprises extruding said alloy into seamless tubes via extrusion of a hollow billet around a mandrel, or into structural tubes via extrusion of solid billets using porthole dies which split metal flow and subsequently merge the metal around a mandrel to form a hollow shape.

Another optional feature of the method is wherein said extruded alloy has a tensile yield strength of at least 180 MPa and an ultimate tensile strength of at least 270 MPa.

Yet another optional feature of the method is wherein said extruded alloy has a tensile yield strength of at least 170 MPa, an ultimate tensile strength of at least 280 MPa and an elongation of at least 7% in tube forms.

According to yet another preferred embodiment of the invention, it may be considered a magnesium-based extrusion alloy composition consisting essentially of, by weight:

7.0%-11.0% Al, 0.1%-0.8% Zn, 0.15%-0.65% Mn, 0.6%-1.5% Ca, 0.05%-0.6% Y and a balance of Mg and unavoidable impurities.

DETAILED DESCRIPTION OF THE DRAWINGS

Figure 1:
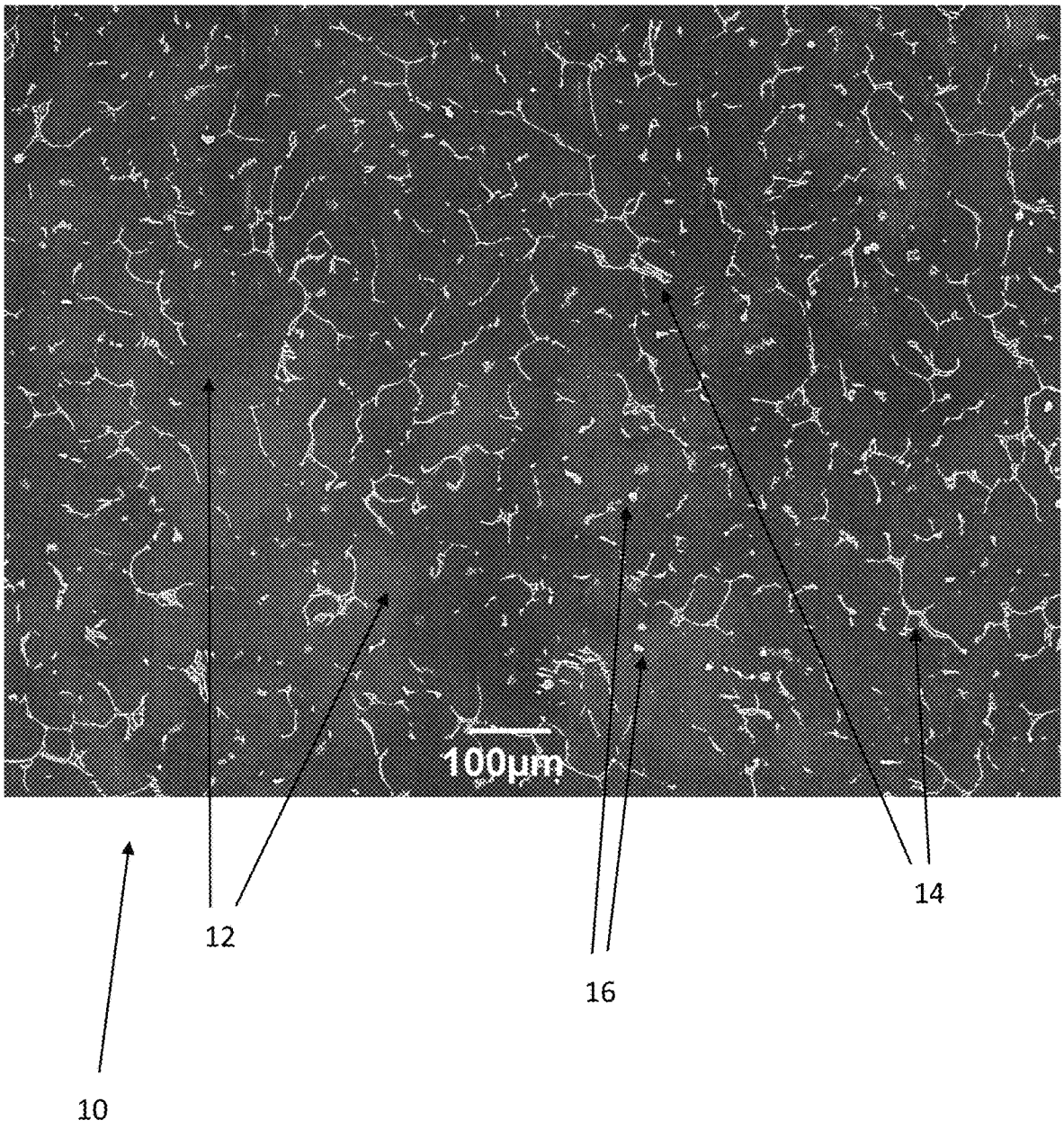
FIG. 1 is an electron micrograph of an alloy of the invention showing an 1280 μm by 960 μm area of the alloy in a cast condition.

FIG. 1 shows an electron micrograph example of the alloy 10 of present invention in an as-cast state. FIG. 1 more specifically shows prominent features of the microstructure including a magnesium matrix phase 12 which makes up most of the microstructure and which contains dissolved aluminum and an aluminum and calcium rich phase 14 that is present in interdendritic spaces left by the magnesium matrix phase. The grain boundaries of the magnesium matrix are not well defined but have sizes well over 100 μm. A 100 μm scale is provided in the figure for size comparison. The aluminum and calcium rich phase is contiguous along some of these boundaries and exists in unbroken linear segments up to 100 μm long. The microstructure also contains blocky Al—Mn—Y particles 16.

Figure 2:
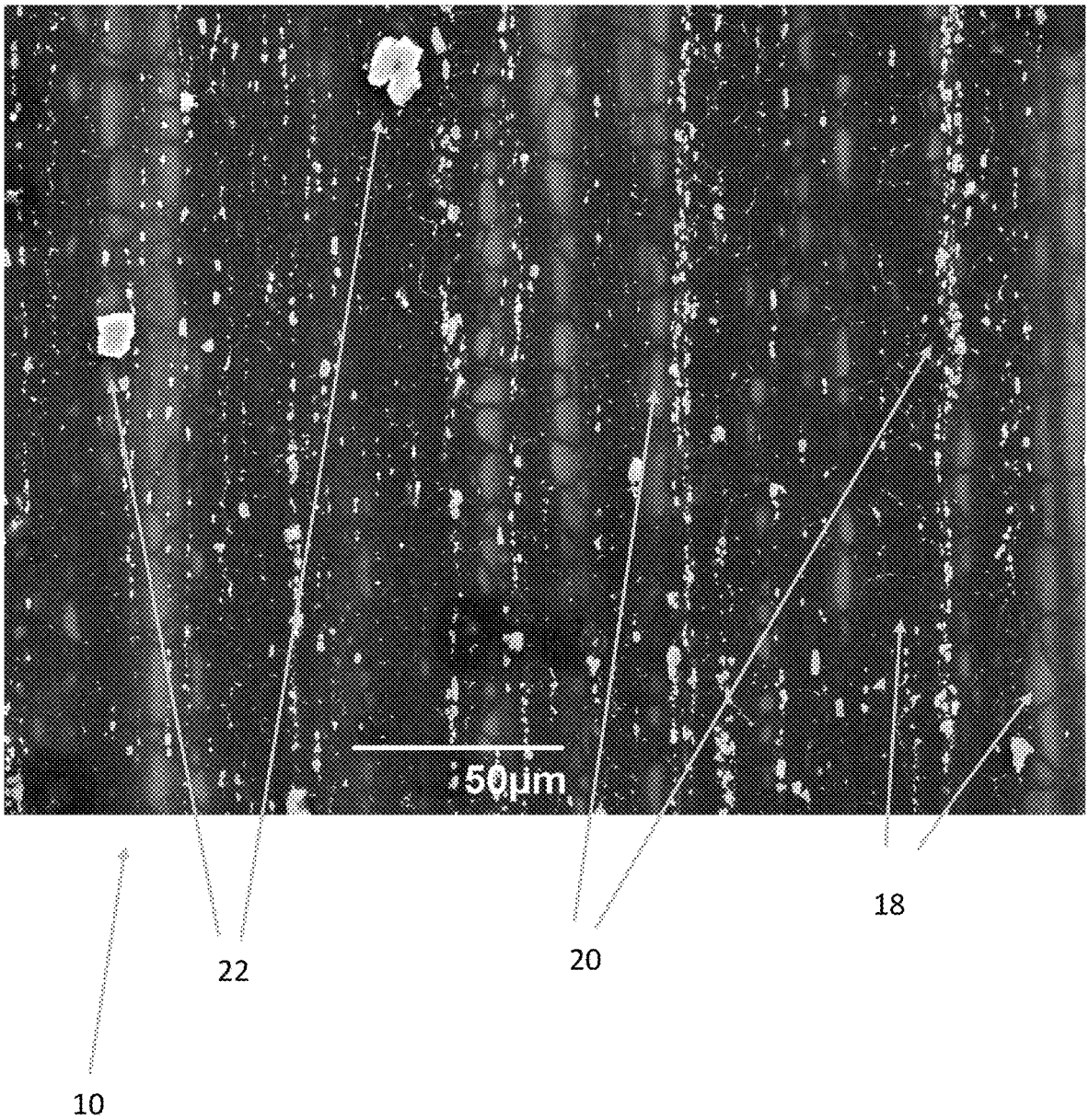
FIG. 2 is an electron micrograph of another alloy of the invention showing a 256 μm by 192 μm area of the alloy in an extruded condition.

FIG. 2 shows another electron micrograph example of the alloy 10 of the present invention in an as-extruded state. The microstructure consists mainly of relatively fine Mg grains 18 having an average diameter of 8.9 μm. A 500 μm scale is provided in the figure for size comparison. The microstructure also contains stringers of Ca-rich particles 20, which have been broken up and distributed throughout the microstructure by the extrusion process. The Ca-rich particles 20 make up approximately 3.9% (by area) of the total microstructure and have an average diameter of 0.48 μm. The thorough distribution of these Ca-rich particles helps pin grain boundaries of the matrix phase during and after extrusion, keeping the material's grain size small and contributing to the material's high strength. The small size of the Ca-rich particles makes them less likely to be a failure initiation site, meaning that there should be little detriment to the material's ductility. The microstructure also contains coarse or blocky Al—Mn—Y particles 22 that have not been broken up by the extrusion process and which do not serve to refine the microstructure.

Figure 3:
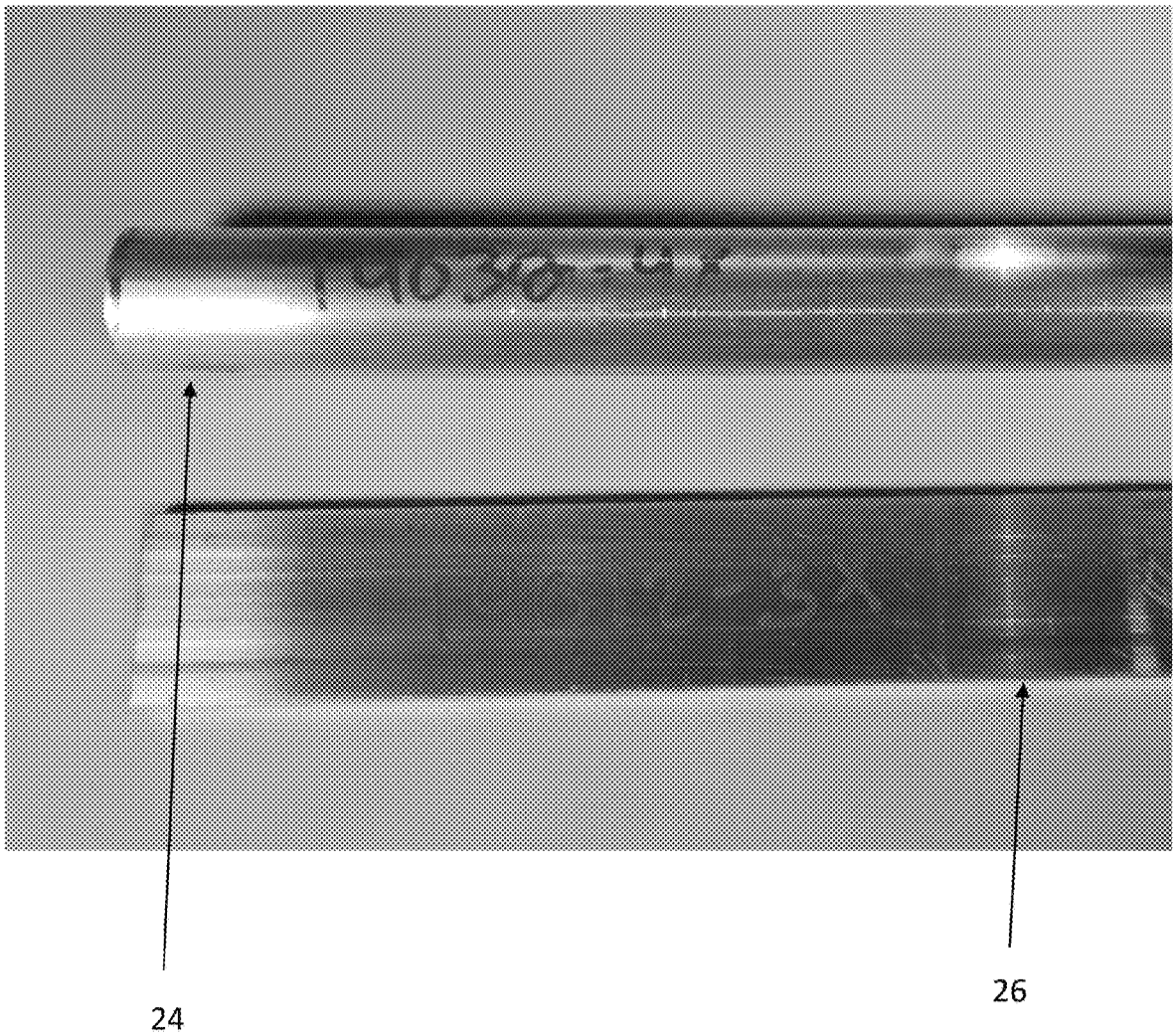
FIG. 3 shows photographs of extruded forms of the alloys.

FIG. 3 shows a photograph of examples of extrusions of the present invention. The present invention is extrudable in both tube form 24 and bar form 26. Other high strength magnesium alloys with aluminum as the principal alloying element are not typically extrudable in tube forms.

As mentioned, according to one preferred embodiment, the invention includes a magnesium alloy with alloying content, in weight percent, between 7.0% and 11.0% aluminum, between 0.1% and 0.8% zinc, between 0.15% and 0.65% manganese, between 0.6% and 1.5% calcium, and between 0.05% and 0.6% yttrium.

According to another feature of the invention, it includes an alloying addition of Mn between about 0.15% and 0.65% by weight. Furthermore, it is preferable that the alloy contain between 0.15% and 0.3% Mn by weight. Manganese is added to Mg—Al alloys to increase corrosion resistance by reducing the Fe impurity levels in the melt during primary processing; dissolved Fe content is very detrimental to Mg alloys' corrosion properties. In the present invention, this preferred range results in low Fe impurity levels and also low amounts of Al—Mn precipitates in the metal, contributing to the invention's superior workability.

According to yet another feature of the invention, it may include an alloying addition of Zn between about 0.1% and 0.8% by weight. In one embodiment, it is preferable that the alloy contain about 0.4% to 0.6% Zn. Zinc is added to the alloy for solid solution strengthening. In this preferred Zn content range, there is some effect of strengthening, but the Zn content is low enough to allow extrusion at moderate speeds and temperatures. In another embodiment of the present invention, it is instead preferable for the Zn content to be between 0.1% and 0.35% of the alloy by weight. This amount of Zn will allow some solid solution strengthening but will allow a slightly higher extrusion temperature, allowing the invention to be extruded at higher speeds.

According to yet another feature of the invention, it may include a Ca addition of between about 0.6 wt. % and 1.5 wt. % and a Y addition of between 0.05 wt. % and 0.6 wt. %. This combined Ca and Y addition imparts flammability resistance to the invention. The most obvious benefit is imparting flammability resistance in the final product, but equally important is the effect of flammability resistance during processing. For the present invention, billets of raw material can be safely preheated to higher temperatures than conventional alloys and can subsequently be extruded at higher temperatures. Higher working temperatures increase the workability of the present invention and allow it to be extruded into tubes and complicated shapes; similar tubes and shapes would be impossible to extrude in conventional high strength Mg—Al alloys.

According to yet another aspect of the invention, it may include a Ca addition resulting in the formation of Mg—Al—Ca intermetallic compounds which are broken up and finely dispersed by a wrought process. These particles contribute to grain refinement during extrusion and help mitigate grain growth immediately after extrusion or during subsequent heat treatment. It is preferred that the invention contain approximately 1.0% to 5.0% (by volume) of such particles and that such particles have an average diameter of less than 1 μm. Furthermore, it is preferred that the Mg matrix grains of the invention have an average diameter of less than about 10 μm resulting from the finely distributed intermetallic compound content of the invention.

According to another aspect of the invention, it is preferred that components of the present invention are produced via extrusion. Any other wrought process which subjects a material to significant shear deformation, and which is capable of breaking up the aforementioned Ca-containing intermetallic particles of the present invention, may also be used, including forging or rolling. The extrusion process accomplishes this by using a hydraulic ram to force a billet through an orifice in the desired shape. The rolling process accomplishes this by using a set of flat rollers to impose successive thickness reduction of a plate or sheet or by using a set of shaped rollers to do the same for simple shapes. The forging process accomplishes this by slowly compressing or rapidly impacting a material one or more times with a hammer, die, or set of progressive dies.

According to yet another aspect of the invention, it may include a total amount of Ca and Y alloying addition be between about 0.75% and 1.5% of the alloy by weight. This amount of Ca and Y alloying addition has been found to give the present invention a favorable volume fraction of Ca-containing and Y-containing precipitates. This is sufficient for grain refinement purposes but will not contribute too much to brittleness. Further, it is preferred that the alloying content of Y be at the low end of the above prescribed 0.05 wt %-0.5 wt. % range, in order to minimize costs associated with rare earth alloying additions.

As set forth, a preferred embodiment of the invention provides an Al alloying addition of about 7.0 wt. % to 11.0 wt. %. This alloying addition may be more preferably an Al content of between about 8.3% and 10% of the alloy by weight. Such an amount of Al content has been found to give the present invention good mechanical properties from solid solution strengthening, while still remaining low enough in total alloying content so that the alloy can be easily extruded. Such an amount of Al content also gives the present invention a $Mg_{17}Al_{12}$ solvus very similar to conventional high strength Mg—Al alloys, meaning that the present invention has a potential for age hardening in a similar manner as conventional high strength Mg—Al alloys.

According to yet another aspect of the invention, it may include a total amount of Al, Ca, and Y alloying additions to not exceed about 11 wt % of the total alloy. This maximum ensures that the material will not become brittle and will maintain workability at safe working temperatures.

Several examples of the present invention demonstrate improved properties over existing commercial alloys. The material examples were produced by casting ingots and subsequent extrusion. Casting consisted of a fluxed process in a steel crucible, using high purity magnesium, aluminum, and zinc metals, manganese chloride, and magnesium-calcium and magnesium-yttrium master alloys as input materials. Molten alloys were gravity cast into permanent steel molds. The chemistry of each example alloy was verified via optical emission spectroscopy (OES). Alloy examples are listed in Table 1. Comparative Example 1 and Comparative Example 2 are commercial alloys AZ61 and AZ80 respectively. For these materials, the compositions listed in Table 1 are the nominal compositions for those alloys instead (not verified by OES), and they were produced using a larger scale direct chill casting process.

TABLE 1

Alloy Chemistries

| | Composition, wt. % | | | | |
|---|---|---|---|---|---|
| Alloy | Al | Ca | Mn | Y | Zn |
| Example 1 | 7.45 | 1.34 | 0.15 | 0.13 | 0.52 |
| Example 2 | 8.34 | 1.41 | 0.17 | 0.14 | 0.62 |
| Example 3 | 8.56 | 0.79 | 0.22 | 0.07 | 0.63 |
| Example 4 | 9.42 | 0.71 | 0.23 | 0.09 | 0.65 |
| Example 5 | 9.98 | 0.66 | 0.18 | 0.08 | 0.64 |
| Example 6 | 8.69 | 0.82 | 0.15 | 0.41 | 0.6 |
| Example 7 | 9.2 | 0.8 | 0.16 | 0.36 | 0.62 |
| Example 8 | 9.97 | 0.83 | 0.24 | 0.56 | 0.6 |
| Example 9 | 9.23 | 1.01 | 0.19 | 0.11 | 0.65 |
| Example 10 | 9.54 | 0.63 | 0.15 | 0.42 | 0.65 |
| Comparative Example 1 | 6.5 | 0 | 0.33 | 0 | 0.95 |
| Comparative Example 2 | 8.5 | 0 | 0.33 | 0 | 0.50 |

Billets were scalped to two final diameters and sectioned to length for extrusion. Billets were preheated in a furnace for up to two hours prior to extrusion. Extrusion was carried out on a 500-ton extrusion press with three die geometries, which correlated to two extrusion profiles. Combinations of billet and die configurations are listed in Table 2. Often, a flat die for a round rod with an extrusion ratio of 25 is used to benchmark extrusion speeds. More complicated shapes and higher reduction ratios are more difficult to extrude, especially for porthole dies and hollow shapes, where higher pressure is required to overcome friction with greater surface area in the die. The choice of dies provided in this example is closer to an industrial setting, and it allows for demonstration of the present invention's superior extrudability in both bar and tube form.

TABLE 2

Extrusion geometries.

| Billet diameter | Die type | Extrudate geometry | Reduction ratio (extrusion ratio) | Alloys used |
|---|---|---|---|---|
| 3.18" | Porthole tube die. | 30 mm outer diameter, 2 mm wall thickness. | 29.28 | Examples 3 - 10 |
| 4.16" | Porthole tube die. | 30 mm outer diameter, 2 mm wall thickness. | 49.86 | Examples 1 - 2, Comp. Example 1 |

TABLE 2-continued

Extrusion geometries.

| Billet diameter | Die type | Extrudate geometry | Reduction ratio (extrusion ratio) | Alloys used |
|---|---|---|---|---|
| 4.16" | Flat die. | 1.5" by 0.25" cross section rectangular bar. | 36.25 | All alloys |

During extrusion, temperatures of the billet, die, and container varied. Temperatures were continually adjusted during experimentation in order to maximize extrusion speed for all example alloys. All temperatures were between 275° C. and 480° C. (527° F.-896° F.), but process temperatures were generally between 370° C. and 480° C. (698° F.-896° F.). Using these conditions and the die geometries in Table 2, the extrusion speeds and mechanical properties of extrudates are listed for bar form in Table 3 and are listed for tube form in Table 4.

TABLE 3

Extrusion and mechanical properties of example alloys in bar form.

| Alloy | Maximum defect-free extrusion speed (feet per minute) | Tensile Yield Strength (MPa) | Ultimate Tensile Strength (MPa) | Elongation after fracture (%) |
|---|---|---|---|---|
| Example 1 | 11.1 | 188 | 298 | 12.72 |
| Example 2 | 8.2 | 194 | 274 | 5.58 |
| Example 3 | 8.2 | 190 | 301 | 12.05 |
| Example 4 | 8.2 | 203 | 307 | 10.29 |
| Example 5 | 5.7 | 217 | 290 | 4.16 |
| Example 6 | 7.3 | 187 | 290 | 7.88 |
| Example 7 | 6.9 | 197 | 276 | 5.81 |
| Example 8 | 6.9 | 208 | 306 | 9.46 |
| Example 9 | 5.4 | 201 | 300 | 8.66 |
| Example 10 | 5.1 | 203 | 299 | 8.47 |
| Comparative Example 1 | 6 | 165 | 275 | 9 |
| Comparative Example 2 | 7 | 195 | 295 | 8 |

TABLE 4

Extrusion and mechanical properties of example alloys in tube form.

| Alloy | Maximum defect-free extrusion speed (feet per minute) | Tensile Yield Strength (MPa) | Ultimate Tensile Strength (MPa) | Elongation after fracture (%) |
|---|---|---|---|---|
| Example 1 | 7 | 199 | 280 | 7.79 |
| Example 2 | 5.6 | 194 | 319 | 9.94 |
| Example 3 | 6.1 | 187 | 306 | 9.16 |
| Example 4 | 5.8 | 188 | 308 | 7.44 |
| Example 5 | 5.1 | 170 | 280 | 6.06 |
| Example 6 | 6.1 | 171 | 295 | 9.21 |
| Example 7 | 5.6 | 173 | 298 | 8.56 |
| Example 8 | 5.3 | 192 | 295 | 6.15 |
| Example 9 | 5.6 | 191 | 302 | 8.34 |
| Example 10 | 5.6 | 183 | 296 | 7.36 |
| Comparative Example 1 | 6 | 110 | 250 | 7 |
| Comparative Example 2 | N/A | N/A | N/A | N/A |

For all Examples of the present invention, strengths in Tables 3 and 4 were measured using the testing procedures described in ASTM B557-15. Tensile properties were measured in the extrusion direction of the material using samples that had 2" gage lengths, 0.50" widths, and nominal thicknesses of the material (listed in Table 2). Tensile Yield Strength was determined via the offset method detailed in ASTM B557-15 section 7.1.6, and it generally refers to the tensile stress that can be imposed on the material before it will permanently deform. Ultimate Tensile Strength is calculated as the maximum force the specimen will withstand, divided by its initial cross-sectional area. Elongation after fracture was determined per the method listed in ASTM B557-15 section 7.8.1, and it generally refers to the percent increase in the specimen's gage length after tension testing. For the commercial alloys AZ61 and AZ80 (Comparative Example 1 and Comparative Example 2, respectively), reference mechanical properties are taken from the relevant alloy specifications in ASTM B107.

Values for mechanical properties listed in Tables 3 and 4 are averages of test sets of up to 12 samples, with any sample discarded which had measurements at least 3 scaled median absolute deviations (MAD) lower than the median (about 2 standard deviations lower than the median), in order to prevent skewing the results due to a defect in the sample. Commercial alloy AZ80 (Comparative Example 2) is widely known to not be extrudable in tube or other hollow forms; as such, properties are not given for Comparative Example 2 in Table 4.

Tables 3 and 4 demonstrate that the present invention has excellent as-fabricated mechanical properties relative to commercial alloys. All Examples well exceed the yield strength of AZ61 (Comparative Example 1) in both tube and bar form. All Examples are also on par with AZ80 (Comparative Example 2) yield strength in bar form, with most Examples exceeding it. With the exception of Example 2, all Examples exceed the ultimate tensile strength (UTS) of AZ61 in bar form, with most Examples on par with or exceeding the UTS of AZ80. All Examples well exceed the UTS of AZ61 in tube form. In bar form, most Examples have elongation on par with or exceeding AZ80, with some examples exceeding the elongation of AZ61. In tube form, most Examples exceed the elongation of AZ61.

Tables 3 and 4 also demonstrate that the present alloys have excellent workability relative to commercial alloys. Most Examples have extrusion speeds on par with that of AZ61 (Comparative Example 1) or AZ80 (Comparative Example 2) in bar form. Some Examples significantly exceed these reference speeds, with Example 1 having an extrusion speed nearly double that of AZ61 in bar form. Unlike AZ80, all Examples are extrudable in tube form. In tube form, most Examples are on par with the extrusion speed of AZ61, with some Examples exceeding AZ61 speeds. In addition to simply being extrudable in tube form, it is especially significant that the present invention is able to maintain mechanical properties on par with AZ80, while being extrudable in tube form.

Selected alloys were tested for flammability by a third party, pursuant to the FAA Aircraft Materials Fire Test Handbook, Chapter 25 (Oil Burner Flammability Test for Magnesium Alloy Seat Structure). Test results are summarized in Table 5.

TABLE 5

Flammability Test Results

| Alloy | Test Result |
|---|---|
| Example 1 | Pass - no burning |
| Example 2 | Not tested |

TABLE 5-continued

| Flammability Test Results | |
|---|---|
| Alloy | Test Result |
| Example 3 | Pass - no burning |
| Example 4 | Pass - no burning |
| Example 5 | Not tested |
| Example 6 | Not tested |
| Example 7 | Not tested |
| Example 8 | Pass - no burning |
| Example 9 | Pass - no burning |
| Example 10 | Pass - no burning |

Comparative Example alloys 1 and 2 were not tested in this manner because they are known to be flammable and are known not to be self-extinguishing. The Example materials which were tested all pass the flammability test requirements and demonstrate clear superiority over conventional alloys, especially for applications which require flammability resistance. Referring to Table 1, the alloys which were tested reflect alloys with a combination of the highest and lowest Ca and Y content, which gives good confidence that all combinations of the present invention have significant flammability resistance.

The alloys described herein are robust and may be produced via many production methods. The preferred production method for Mg alloys according to the present work is direct chill (DC) casting followed by extrusion, but it is not intended that the present invention be limited to a specific process. Rather the process may be designed for several other casting and wrought processes not mentioned in detail. Such casting methods include but are not limited to sand casting, gravity die casting, tilt casting, low pressure die casting, high pressure die casting, strip casting, continuous casting, squeeze casting, centrifugal casting, thixomolding, and rheocasting. Such wrought processing methods include but are not limited to extrusion, rolling, and forging.

What is claimed is:

1. A magnesium-based extrusion alloy composition comprising, by weight:

7.0%-11.0% Al, 0.1%-0.8% Zn, 0.15%-0.65% Mn, more than 0.63% Ca, less than 0.56% Y and a balance of Mg and unavoidable impurities; and wherein a total combined content of said Al, Ca, and Y does not exceed 11 wt % of said alloy; and wherein said alloy comprises Ca in the form of intermetallic particles;

wherein said intermetallic compounds of Ca and Y comprise: Mg—Al—Ca compounds and Al—Mn—Y compounds, respectively;

wherein said Ca and Y intermetallic compounds contribute to flammability resistance of wrought products made from said alloy;

wherein said intermetallic particles are formed in a wrought process, including extrusion, rolling, or forging;

when said alloy is provided in a matrix phase, said intermetallic particles making up said alloy have an average diameter of 10 μm or less;

said alloy comprises Ca intermetallic particles and said intermetallic particles make up between 1.0% to 5.0% of said alloy by volume; and said magnesium-based extrusion alloy composition is a forged or drawn alloy that has a yield strength of at least 170 MPa, an ultimate tensile strength of at least 280 MPa and an elongation of at least 7% in tube forms.

2. The alloy according to claim 1 wherein:

a content of said Mn is between 0.15 wt % to 0.3 wt % of said alloy.

3. The alloy according to claim 1 wherein:

a content of said Zn is between 0.1 wt % to 0.35 wt % of said alloy.

4. The alloy according to claim 1 wherein:

a content of said Al is between 8.3 wt % to 10 wt % of said alloy.

5. The alloy according to claim 1 wherein:

said Ca and said Y are provided in intermetallic compounds.

6. The alloy, according to claim 1, wherein:

said Mg—Al—Ca intermetallic compound comprises: up to 57 wt % Al and up to 43 wt % Ca.

7. The alloy, according to claim 1, wherein:

said Al—Mn—Y intermetallic compound comprises 40 wt % Al, 40 wt % Mn and 20 wt % Y.

* * * * *